US010819068B2

(12) United States Patent
Motoshige

(10) Patent No.: US 10,819,068 B2
(45) Date of Patent: Oct. 27, 2020

(54) LEVER CONNECTOR

(71) Applicant: Yazaki Corporation, Tokyo (JP)

(72) Inventor: Yuichi Motoshige, Kakegawa (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/438,998

(22) Filed: Jun. 12, 2019

(65) Prior Publication Data

US 2019/0386429 A1 Dec. 19, 2019

(30) Foreign Application Priority Data

Jun. 14, 2018 (JP) ..... 2018-113681

(51) Int. Cl.
*H01R 13/629* (2006.01)
*H01R 12/71* (2011.01)

(52) U.S. Cl.
CPC ..... *H01R 13/62938* (2013.01); *H01R 12/71* (2013.01); *H01R 13/62905* (2013.01); *H01R 13/62955* (2013.01)

(58) Field of Classification Search
CPC ..... H01R 13/62938; H01R 13/62955; H01R 13/62933; H01R 13/62905; H01R 12/71
USPC ..... 439/157, 181
See application file for complete search history.

(56) References Cited

U.S. PATENT DOCUMENTS 5,230,635 A * 7/1993 Takenouchi ..... H01R 13/62938 439/153
6,500,015 B2 * 12/2002 Fukamachi ..... H01R 13/62905 439/157
6,659,783 B2 * 12/2003 Copper ..... H01R 13/53 361/2
6,982,393 B2 * 1/2006 Matsui ..... H01R 13/62933 200/335
8,986,024 B2 * 3/2015 Ikeda ..... H01H 9/102 439/157
9,171,685 B2 * 10/2015 Henmi ..... H01H 35/003
2005/0098419 A1 5/2005 Matsui et al.
2013/0126205 A1 5/2013 Henmi

FOREIGN PATENT DOCUMENTS

JP 11-329579 A 11/1999
JP 2005-142107 A 6/2005
JP 2012-243559 A 12/2012
JP 2013-109944 A 6/2013

* cited by examiner

*Primary Examiner* — Hien D Vu
(74) *Attorney, Agent, or Firm* — Sughrue Mion, PLLC

(57) ABSTRACT

A lever connector includes a first connector housing, a second connector housing fitted to and detached from the first connector housing, a lever rotatably supported by the second connector housing, a cam pin formed in the first connector housing, and a cam groove formed in the lever, pressing the cam pin by rotation of the lever, and applies a fitting force and a detachment force between the first connector housing and the second connector housing. The cam pin is slidably disposed in the cam groove. Further, the corn pin is disposed on a lateral side of a rotation center of the lever, and is disposed on a detachment side of the second connector housing relative to a line that passes through the rotation center and is orthogonal to an insertion/removal direction of the first connector housing and the second connector housing.

3 Claims, 13 Drawing Sheets

LEVER CONNECTOR

CROSS-REFERENCE TO RELATED APPLICATIONS

This application is based on and claims priority under 35 USC 119 from Japanese Patent Application No. 2018-113681 filed on Jun. 14, 2018, the contents of which are incorporated herein by reference.

TECHNICAL FIELD

The present invention relates to a lever connector.

BACKGROUND ART

A lever connector, which applies a fitting force and a detachment force to connector housings by rotation of a lever (see, for example, Patent Documents 1 and 2), has been known.

Patent Document 1: JP-A-2012-243559

Patent Document 2: JP-A-2005-142107

SUMMARY OF INVENTION

In the above-described lever connector, increasing a length of the lever is performed as a method of reducing an operating force for the lever. However, the lever size is increased when the lever is lengthened, and thereby leads to an increase in the size of the entire connector.

The present invention has been made in view of the above-described problems, and an object thereof is to provide a lever connector which can ensure good operability and reduce in size.

In order to achieve the above object, a lever connector according to the present invention is characterized by the following (1) to (3).

(1) A lever connector includes:

a first connector housing;

a second connector housing that is fitted to/detached from the first connector housing;

a lever rotatably supported by the second connector housing;

a cam pin formed in the first connector housing; and a cam groove that is formed in the lever, presses the cam pin by rotation of the lever, and applies a fitting force and a detachment force between the first connector housing and the second connector housing, the cam pin being slidably disposed in the cam groove, wherein in a finally fitted state that the first connector housing is completely fitted to the second connector housing, the cam pin is disposed on a lateral side of a rotation center of the lever, and is disposed on a detachment side of the second connector housing relative to a line that passes through the rotation center and is orthogonal to an insertion/removal direction of the first connector housing and the second connector housing.

(2) The lever connector according to (1), wherein the first connector housing and the second connector housing include switch units including a terminal inserted/removed by fitting/removing the first connector housing and the second connector housing, and the rotation center and the cam pin are disposed on two sides of a center line of the switch units.

(3) The lever connector according to (2), wherein the rotation center and the cam pin are disposed at an equal distance from the center line of the switch units.

According to the lever connector having the configuration of the above (1), the cam pin is disposed on the lateral side of the rotation center of the lever, and disposed on the detachment side of the second connector housing relative to the line, which passes through the rotation center and is orthogonal to the insertion/removal direction of the first connector housing and the second connector housing, so that the length of the cam groove of the lever can be reduced. For this reason, both the lever and the entire connector can be miniaturized.

In addition, a shape of the cam groove can further approximate to an arc by reducing the length of the cam groove of the lever. Accordingly, the pressing force generated by the rotation of the lever can be further applied along the insertion/removal direction, and the pressing force can be prevented from being wasted and can be used as the fitting force and the detachment force. Further, the operability can be improved.

According to the lever connector having the configuration of the above (2), the rotation center and the cam pin to which the fitting force and the detachment force are applied by rotating the lever are disposed on two sides of the center line of the switch units. Therefore, the fitting force and the detachment force applied by the rotation of the lever are applied in a well-balanced manner, so that the terminals of the switch unit can be smoothly inserted and removed, and the on/off operation of the switch unit can be favorably performed.

According to the lever connector having the configuration of the above (3), the rotation center and the cam pin are disposed at an equal distance from the center line of the switch units, and thus the fitting force and the detachment force applied by the rotation of the lever can be applied in a more balanced manner, and the terminals of the switch unit can be smoothly inserted and removed.

The present invention provides a lever connector by which good operability can be ensured and reduction in size can be achieved.

The present invention has been briefly described as above. Details of the invention will be further clarified by reading a mode (hereinafter, referred to as "embodiment") for carrying out the invention described below with reference to the accompanying drawings.

BRIEF DESCRIPTION OF DRAWINGS

FIG. 7A is a side view of the lever connector in a finally fitted state according to the embodiment of the present invention, and FIG. 7B is a side view of the lever connector in a temporarily fitted state according to the embodiment of the present invention.

FIG. 8A is a side view of the lever connector in a finally fitted state according to the reference example, and FIG. 8B is a side view of the lever connector in a temporarily fitted state according to the reference example.

FIG. 9A is a schematic diagram illustrating a method of setting a guide shape in the lever connector according to the embodiment of the present invention, and FIG. 9B is a schematic diagram illustrating a method of setting a guide shape in the lever connector according to the reference example.

DESCRIPTION OF EMBODIMENTS

Hereinafter, embodiments according to the present invention will be described with reference to the drawings.

Figure 1:
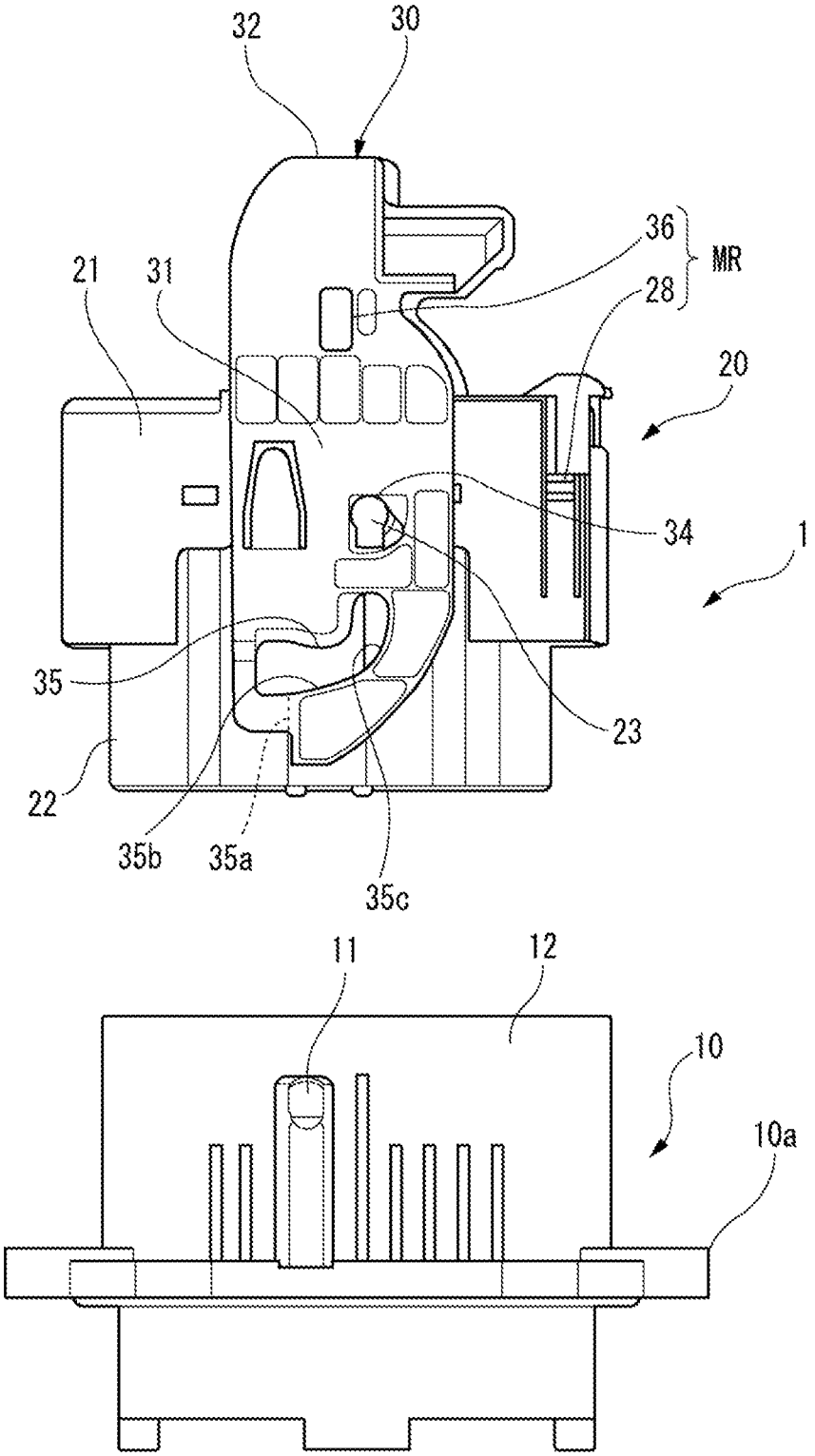
FIG. 1 is a side view of a first connector housing and a second connector housing of a lever connector according to an embodiment of the present invention.
Figure 2:
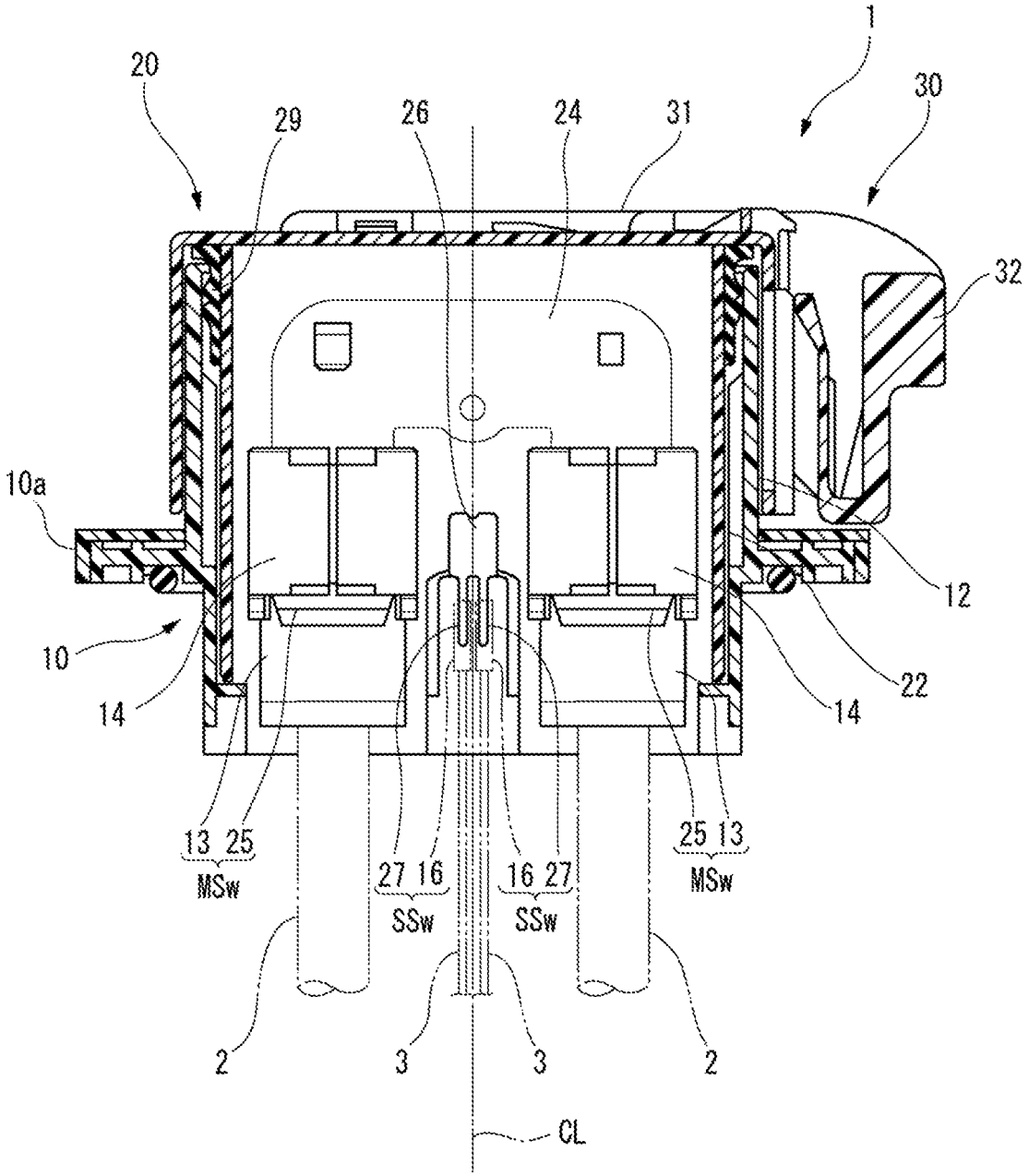
FIG. 2 is a sectional view of the lever connector taken along an upper-lower direction.
Figure 3:
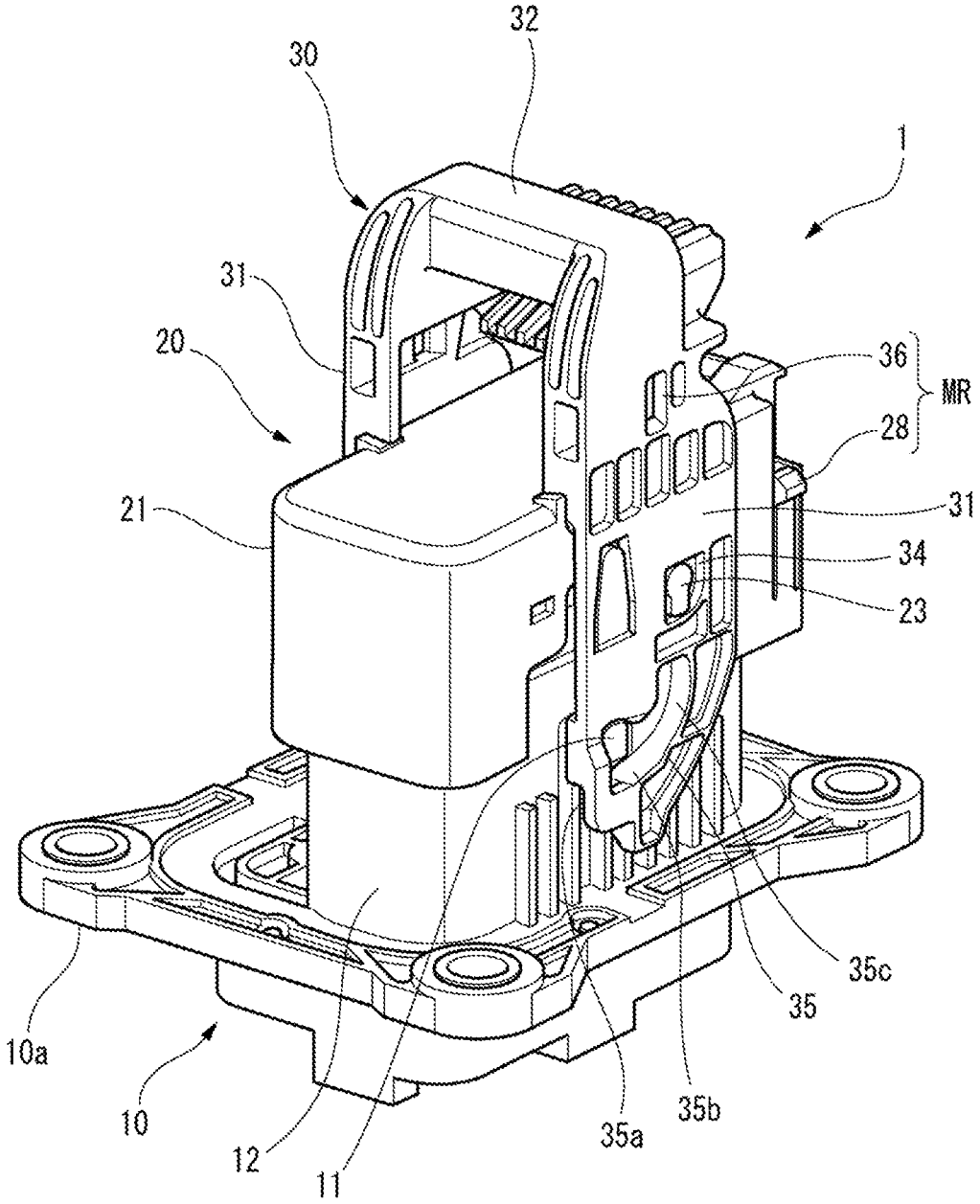
FIG. 3 is a perspective view of the lever connector in which the first connector housing and the second connector housing are in a temporarily fitted state.
Figure 4:
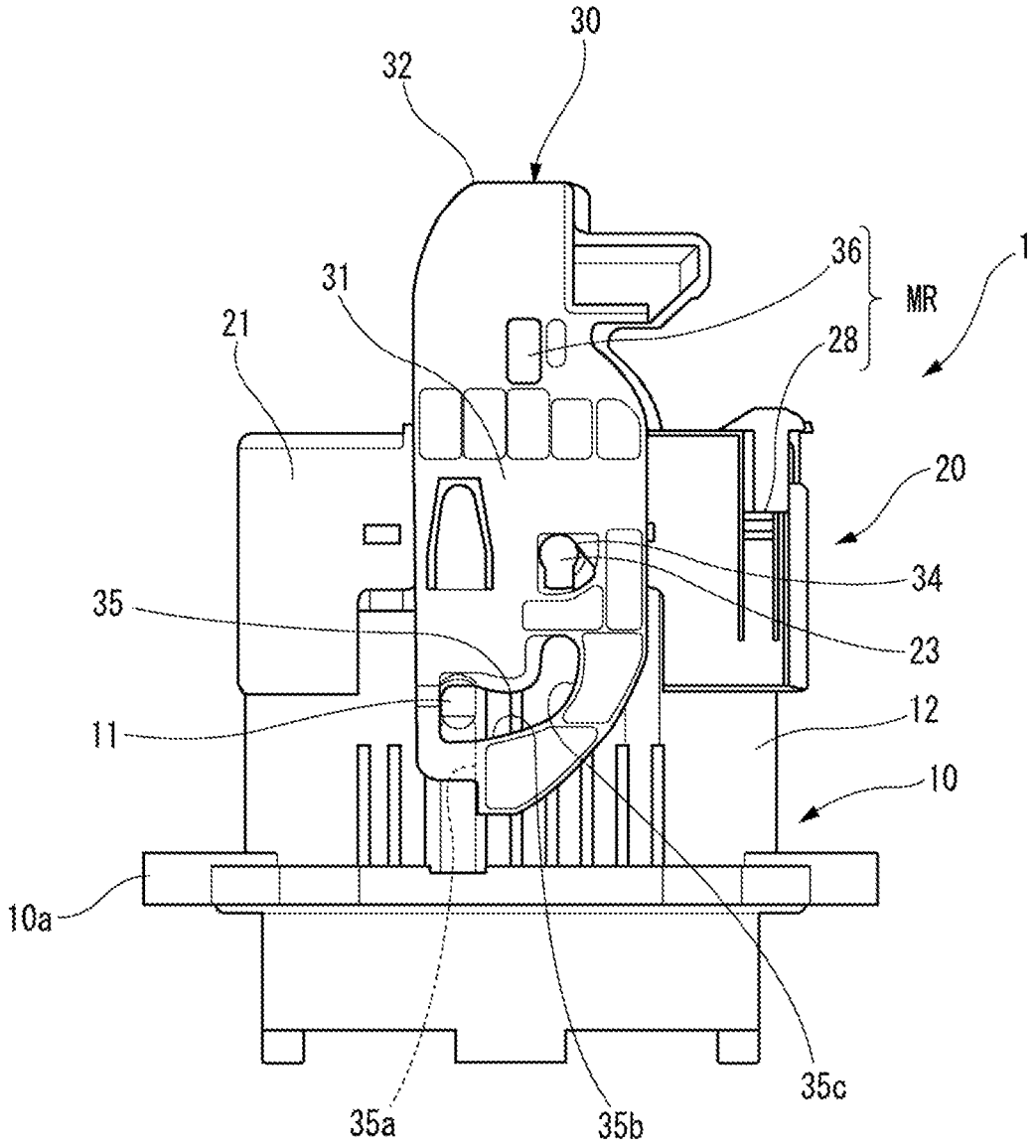
FIG. 4 is a side view of the lever connector in which the first connector housing and the second connector housing are in the temporarily fitted state.
Figure 5:
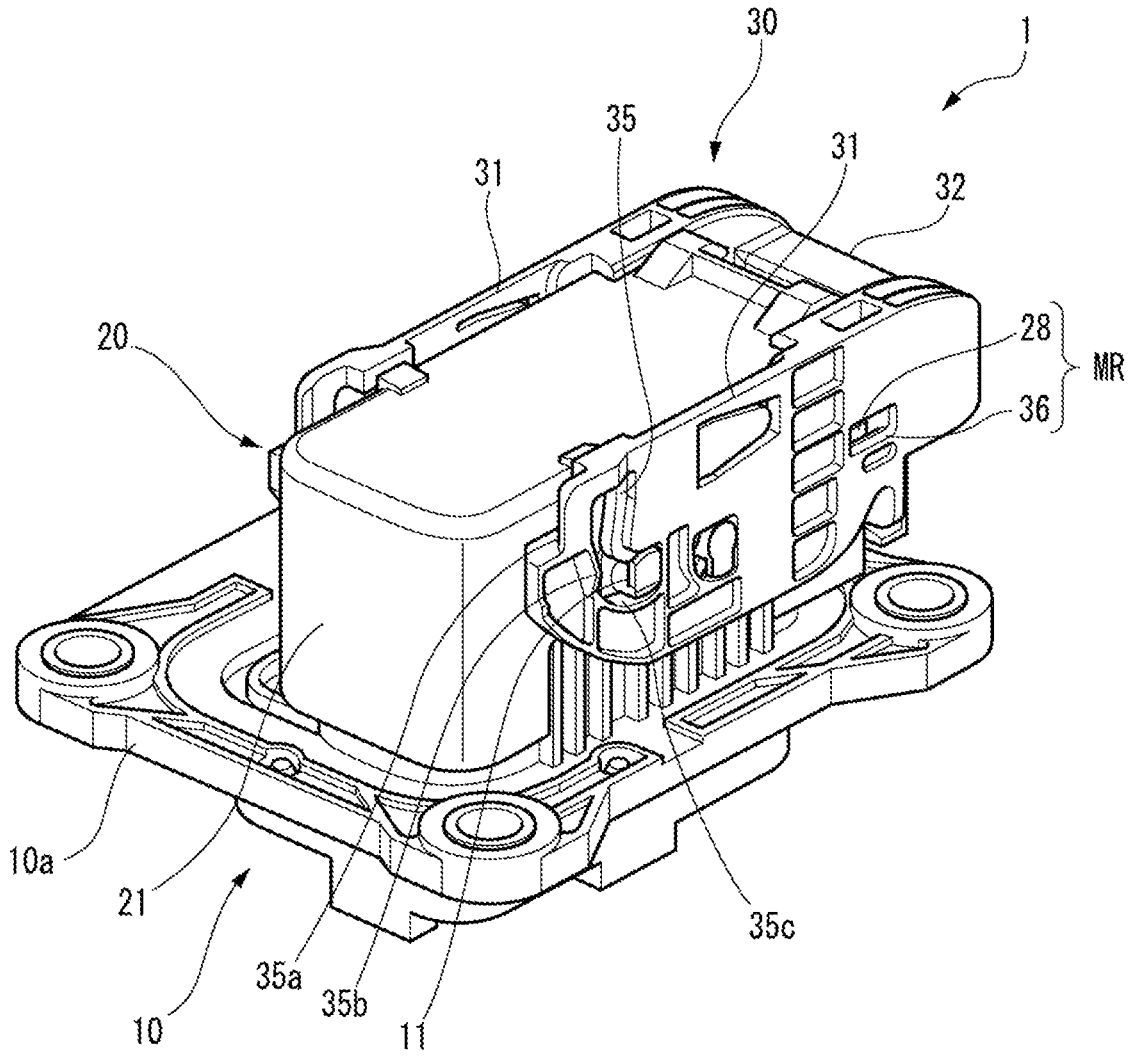
FIG. 5 is a perspective view of the lever connector in which the first connector housing and the second connector housing are in a finally fitted state.
Figure 6:
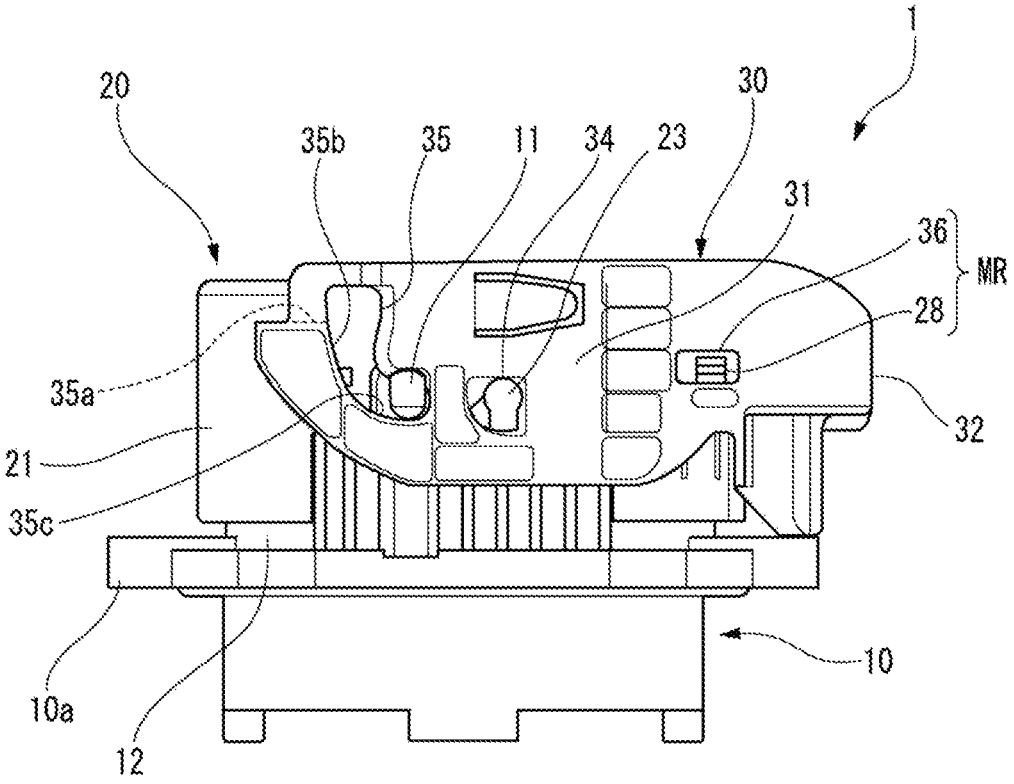
FIG. 6 is a side view of the lever connector in which the first connector housing and the second connector housing are in the finally fitted state.

FIG. 1 is a side view of a first connector housing and a second connector housing of a lever connector according to an embodiment of the present invention. FIG. 2 is a sectional view of the lever connector, which is taken along an upper-lower direction. FIG. 3 is a perspective view of the lever connector in which the first connector housing and the second connector housing are in a temporarily fitted state. FIG. 4 is a side view of the lever connector in which the first connector housing and the second connector housing are in the temporarily fitted state. FIG. 5 is a perspective view of the lever connector in which the first connector housing and the second connector housing are in a finally fitted state. FIG. 6 is a side view of the lever connector in which the first connector housing and the second connector housing are in the finally fitted state.

As illustrated in FIGS. 1 to 6, a lever connector 1 according to the embodiment of the present invention includes a first connector housing 10 and a second connector housing 20. The second connector housing 20 can be fitted to and detached from the first connector housing 10. The second connector housing 20 includes a lever 30. The lever 30 is set to be rotatable relative to the second connector housing 20. A fitting force and a detachment force are applied between the second connector housing 20 and the first connector housing 10 by rotating the lever 30.

In order to ensure work safety in maintenance of an electrical system or the like, the lever connector 1 is used as a service plug that disconnects energization between a power supply unit and a load in, for example, a vehicle such as an electric vehicle or a hybrid vehicle. Specifically, electricity can be conducted between the power supply unit and the load when the second connector housing 20 is fitted to the first connector housing 10. The energization between the power supply unit and the load is disconnected when the second connector housing 20 is detached from the first connector housing 10.

The first connector housing 10 is formed of an insulating synthetic resin. The first connector housing 10 includes flange portions 10*a* projecting outward and is mounted on a power supply device or the like by fixing the flange portions 10*a* to a case. A pair of cam pins 11 are protruded from two lateral surfaces of the first connector housing 10. In addition, the first connector housing 10 includes an accommodating tubular portion 12 whose upper surface is open. The accommodating tubular portion 12 is formed into a rectangular shape in a plan view. A pair of main terminals 13 are provided inside the accommodating tubular portion 12 of the first connector housing 10. Each of the main terminals 13 includes a bus bar formed of a conductive metal material. Each of the main terminals 13 includes a female terminal portion 14 at one end thereof. A power supply line 2 from the power supply device or the like is connected to the other end of each of the main terminals 13. In addition, a pair of sub terminals 16 including female terminals are provided inside the accommodating tubular portion 12 of the first connector housing 10. A signal line 3 is connected to each of the sub terminals 16.

The second connector housing 20 is formed of an insulating synthetic resin and includes an outer peripheral tubular portion 21 and a fitting tubular portion 22. A pair of support shafts 23 protrude from two lateral surfaces of the outer peripheral tubular portion 21. In addition, a pair of main lock claws 28 are formed near ends of two lateral surfaces of the outer peripheral tubular portion 21, respectively. The fitting tubular portion 22 is formed into a tubular shape whose lower portion is open, and is formed in a rectangular shape in a plan view. The rectangular shape is slightly smaller than an outer shape of the accommodating tubular portion 12 of the first connector housing 10. A packing 29 is provided at a root portion of an outer peripheral side of the fitting tubular portion 22. The second connector housing 20 is fitted from an upper side of the accommodating tubular portion 12 such that the fitting tubular portion 22 is fitted to the accommodating tubular portion 12 of the first connector housing 10. Then, the fitting tubular portion 22 is fitted into the accommodating tubular portion 12, so that the accommodating tubular portion 12 enters space between the fitting tubular portion 22 and the outer peripheral tubular portion 21. In addition, when the fitting tubular portion 22 is fitted into the accommodating tubular portion 12, an inner peripheral surface of an upper end of the accommodating tubular portion 12 comes into close contact with the packing 29, and space between the accommodating tubular portion 12 and the fitting tubular portion 22 is waterproof.

A main bus bar 24 formed of a conductive metal material is provided inside the second connector housing 20. The main bus bar 24 includes a pair of male terminal portions 25 at two end portions thereof. The male terminal portions 25 can be connected to the female terminal portions 14 of the main terminals 13 of the first connector housing 10, respectively. When the male terminal portions 25 of the main bus bar 24 are connected to the female terminal portions 14 of the main terminals 13, the power supply lines 2 connected to the main terminals 13 are electrically connected to each other via the main bus bar 24. A sub-bus bar 26 formed of a conductive metal material is provided inside the fitting tubular portion 22 of the second connector housing 20. The sub-bus bar 26 includes a pair of male terminal portions 27. The male terminal portions 27 of the sub-bus bar 26 can be connected to the sub terminals 16 of the first connector housing 10, respectively. When the male terminal portions 27 of the sub-bus bar 26 are connected to the sub terminals 16, the signal lines 3 connected to the sub terminals 16 are electrically connected to each other via the sub-bus bar 26.

As described above, the lever connector 1 includes main switch units MSw each including the main terminal 13 and the male terminal portion 25 of the main bus bar 24, and sub-switch units SSw each including the sub terminal 16 and the male terminal portion 27 of the sub-bus bar 26. In the power supply device including the lever connector 1, a power supply circuit is formed when the main switch units MSw are turned on and the power supply lines 2 are electrically connected to each other, and a signal circuit is formed when the sub-switch units SSw are turned on and the signal lines 3 are electrically connected to each other.

The lever 30 is formed of a synthetic resin and includes a pair of arm portions 31 and a connection portion 32. One end of one arm portion 31 is connected to one end of the other arm portion 31 by the connection portion 32, and each of the arm portions 31 includes a shaft receiving hole 34 on the other end. The pair of support shafts 23 of the second connector housing 20 are inserted into the shaft receiving holes 34 of the arm portions 31, respectively. Accordingly, the lever 30 is rotatably supported by the second connector housing 20.

Cam grooves 35 are formed on the pair of arm portions 31 of the lever 30, respectively. The cam pins 11 of the first connector housing 10 are inserted into the cam grooves 35, respectively. Each of the cam grooves 35 includes an insertion portion 35*a* into/from which the cam pin 11 can be inserted/removed, a curved portion 35*b* communicating with the insertion portion 35*a*, and a bent portion 35*c* communicating with the curved portion 35*b*. The curved portion 35*b* is formed with a curve that gradually approaches a center of the shaft receiving hole 34 from the insertion portion 35*a*. The bent portion 35*c* is bent from the curved portion 35*b* toward the center of the shaft receiving hole 34.

The lever 30 is rotated between a first operation position (position illustrated in FIG. 4) and a second operation position (position illustrated in FIG. 6) when the cam pin 11 moves in the cam groove 35. In the first operation position, the cam pin 11 is inserted into the insertion portion 35*a*. In the second operation position, the cam pin 11 is disposed at the deepest position of the bent portion 35*c*.

Further, between the first connector housing 10 and the second connector housing 20, a fitting force toward a fitting direction is applied when the lever 30 is rotated from the first operation position to the second operation position, and a detachment force toward a detachment direction is applied when the lever 30 is rotated from the second operation position to the first operation position.

Main lock holes 36 are formed on portions, which are in vicinity of the connection portion 32, of the arm portions 31 of the lever 30. The main lock claws 28 are engaged with these main lock holes 36. The main lock claws 28 are formed on the outer peripheral tubular portion 21 of the second connector housing 20. Further, a main lock portion MR is constituted by the main lock claws 28 and the main lock hole 36. In the main lock portion MR, the main lock claw 28 is engaged with the main lock hole 36 in a state where the lever 30 is disposed at the second operation position, so that the lever 30 is locked to the second connector housing 20 and rotation of the lever 30 is restricted. Accordingly, the second connector housing 20 is locked to the first connector housing 10 in a completely fitted state. Further, the finally fitted state refers to a state where the first connector housing 10 is completely fitted to the second connector housing 20 in the lever connector 1 and they are locked by the main lock portion MR.

Next, a case where the second connector housing 20 is fitted to/detached from the first connector housing 10 will be described.

(Fitting Case)

In order to fit the second connector housing 20 to the first connector housing 10, the second connector housing 20 on which the lever 30 is disposed at the first operation position is brought close to the first connector housing 10. Further, the fitting tubular portion 22 of the second connector housing 20 is fitted into the accommodating tubular portion 12 of the first connector housing 10.

Then the fitting tubular portion 22 of the second connector housing 20 is fitted into the accommodating tubular portion 12 of the first connector housing 10, the cam pin 11 is inserted into the cam groove 35 of the lever 30 from the insertion portion 35*a*. Accordingly, the second connector housing 20 is temporarily fitted into the first connector housing 10 (see FIGS. 4 and 5).

In this temporarily fitted state, the lever 30 at the first operation position is rotated toward the second operation position. Then, the cam pin 11 moves along the curved portion 35*b* and the bent portion 35*c*, a fitting force is applied between the first connector housing 10 and the second connector housing 20, and the second connector housing 20 is pulled into the first connector housing 10 so as to be brought into the finally fitted state (see FIGS. 6 and 7). Once in the finally fitted state, the fitting tubular portion 22 of the second connector housing 20 is completely fitted to the accommodating tubular portion 12 of the first connector housing 10, and the accommodating tubular portion 12 enters the space between the fitting tubular portion 22 and the outer peripheral tubular portion 21. Further, the inner peripheral surface of the upper end of the accommodating tubular portion 12 comes into close contact with the packing 29, so that the space between the accommodating tubular portion 12 and the fitting tubular portion 22 is waterproof.

In the finally fitted state, the male terminal portions 25 of the main bus bar 24 are connected to the female terminal portions 14 of the main terminals 13, respectively. That is, the main switch units MSw are turned on, and the power supply lines 2 connected to the main terminals 13 are electrically connected to each other via the main bus bar 24. In addition, the male terminal portions 27 of the sub-bus bar 26 are connected to the sub terminals 16, respectively. That is, the sub-switch units SSw are turned on, and the signal lines 3 connected to the sub terminals 16 are electrically connected to each other via the sub-bus bar 26.

In addition, in the finally fitted state, the main lock claws 28 formed on the outer peripheral tubular portion 21 of the second connector housing 20 are respectively engaged with the main lock holes 36 of the lever 30 in the main lock portion MR. Accordingly, the lever 30 is locked in the second operation position, and the rotation of the lever 30 is restricted. As described above, in the finally fitted state, the main lock portion MR restricts the rotation of the lever 30, so that the first connector housing 10 and the second connector housing 20 are locked in a completely fitted state to maintain the finally fitted state.

(Detachment Case)

In order to detach the second connector housing 20 from the first connector housing 10, the lever 30 disposed at the second operation position is grasped and pulled up. Then, the main lock claws 28 of the second connector housing 20 come off from the main lock holes 36 of the lever 30, and the lock of the lever 30 by the main lock portion MR that maintains the finally fitted state is released, so that the lever 30 becomes rotatable.

The lever 30 that is rotatable is rotated toward the first operation position. Then, with the rotation of the lever 30, the cam pin 11 moves along the bent portion 35*c* and the curved portion 35*b*, and a detachment force is applied between the first connector housing 10 and the second connector housing 20. The second connector housing 20, which is in the finally fitted state with the first connector housing 10, is displaced to a direction in which the second connector housing 20 is detached from the first connector housing 10, so as to be brought into the temporarily fitted state (see FIGS. 4 and 5).

Once in the temporarily fitted state, the male terminal portions 27 of the sub-bus bar 26 are pulled out from the sub terminals 16, respectively. That is, the sub-switch units SSw are turned off, and the electrical connection between the signal lines 3 is released. From the temporarily fitted state, the second connector housing 20 is separated from the first connector housing 10. Then, the fitting tubular portion 22 of the second connector housing 20 is extracted from the accommodating tubular portion 12 of the first connector housing 10, and the male terminal portions 25 of the main bus bar 24 are pulled out from the female terminal portions 14 of the main terminal 13. Accordingly, the main switch units MSw are turned off, the electrical connection between the power supply lines 2 is released.

Next, a positional relationship between a rotation center of the lever 30 and the cam pin 11 provided on the first connector housing 10 will be described. The lever 30 is supported by the support shaft 23 of the second connector housing 20, and the cam pin 11 moves relative to the cam groove 35 of the lever 30. It should be noted that the first connector housing 10 side is described as a lower side, and the fitting/detachment direction of the second connector housing 20 relative to the first connector housing 10 is described as an upper-lower direction.

Figure 7B:
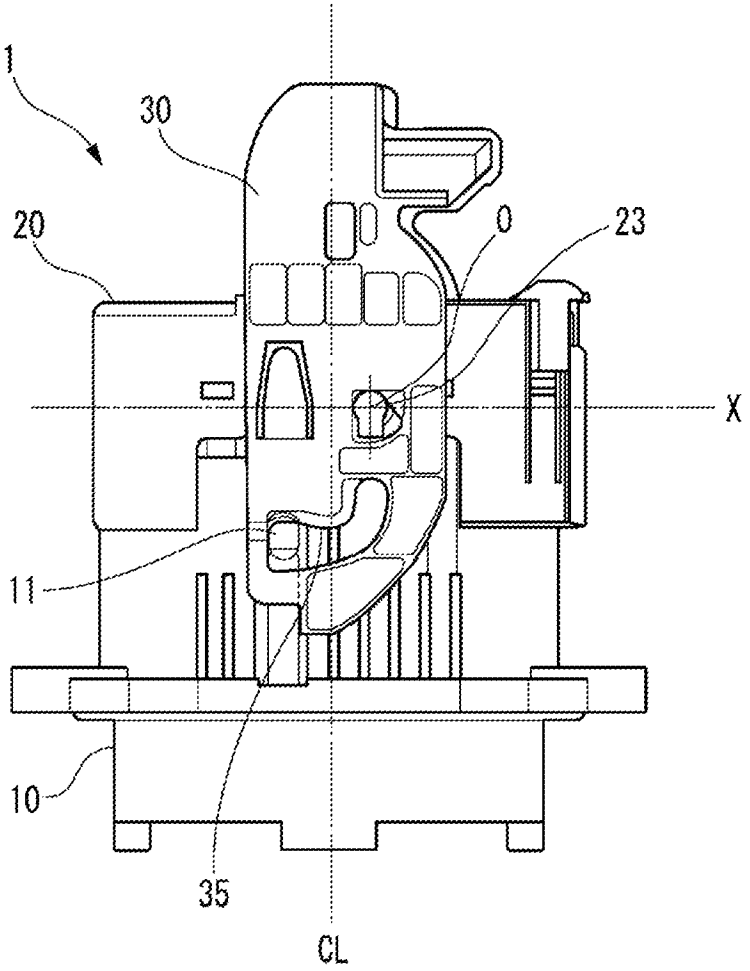
FIGS. 7A and 7B are views illustrating a positional relationship between a rotation center of the lever in the lever connector and a cam pin that moves relative to a cam groove according to the embodiment of the present invention.
Figure 7A:
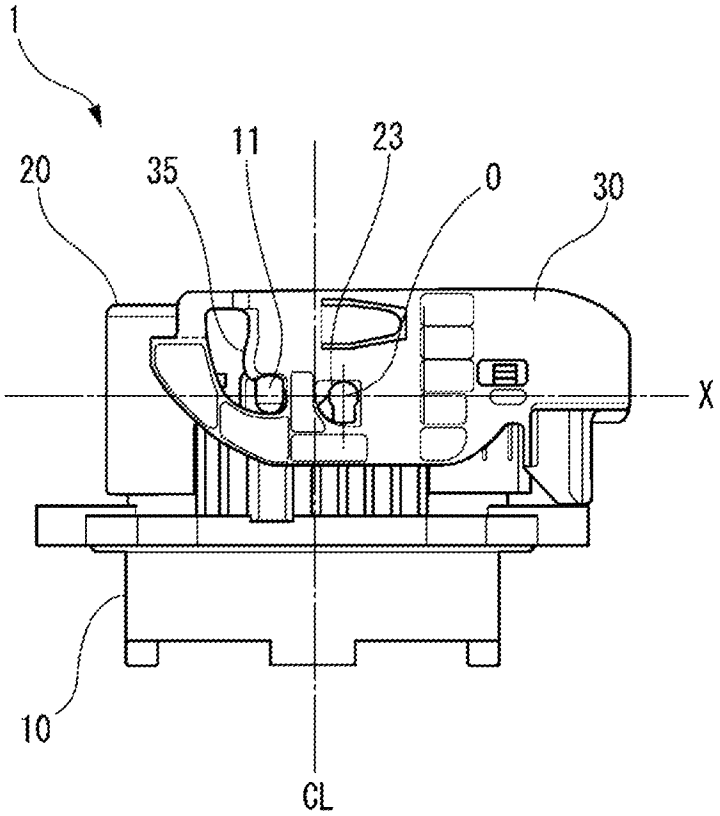

FIG. 7 is a view illustrating a positional relationship between the rotation center of the lever in the lever connector according to the present embodiment and the cam pin that moves relative to the cam groove, in which FIG. 7A is a side view of the lever connector according to the present embodiment in a finally fitted state, and FIG. 7B is a side view of the lever connector according to the present embodiment in a temporarily fitted state.

As illustrated in FIG. 7A, in the lever connector 1 according to the present embodiment, the cam pin 11 of the first connector housing 10 is disposed on a lateral side of a rotation center O of the lever 30 supported by the support shaft 23 of the second connector housing 20 in the finally fitted state. Further, the cam pin 11 is disposed on an upper side of a horizontal line X that passes through the rotation center O of the lever 30 and is orthogonal to an insertion/removal direction, which is a detachment side. In addition, in the finally fitted state, the rotation center O of the lever 30 and the cam pin 11 of the first connector housing 10 are disposed on two sides of a center line CL (see FIG. 2) of the main switch units MSw and of the sub-switch units SSw. The rotation center O and the cam pin 11 are disposed at an equal distance from the center line CL.

As illustrated in FIG. 7B, the cam pin 11 is pushed down along the cam groove 35 when the lever 30 at the second operation position is pulled up to rotate to the first operation position, so that the support shaft 23 is pushed up relative to the cam pin 11. Accordingly, the second connector housing 20 is displaced toward the detachment direction relative to the first connector housing 10.

Next, a lever connector according to a reference example will be described.

Figure 8B:
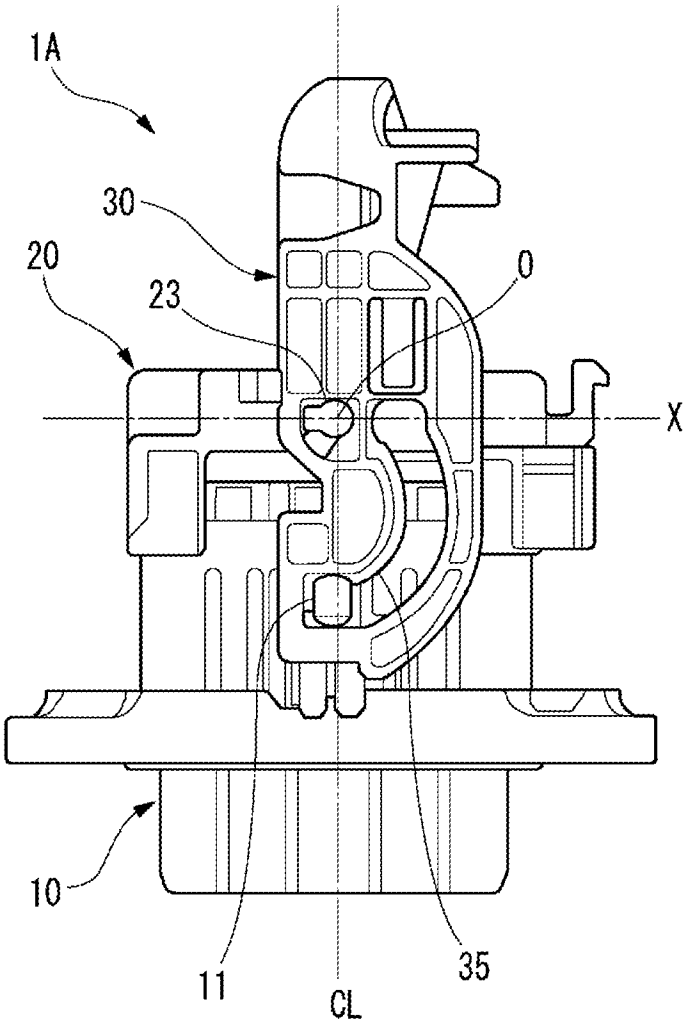
FIGS. 8A and 8B are views illustrating a positional relationship between a rotation center of a lever in a lever connector and a cam pin that moves relative to a cam groove according to a reference example.

FIG. 8 is a view illustrating a positional relationship between a rotation center of a lever in the lever connector according to the reference example and a cam pin that moves relative to a cam groove, in which FIG. SA is a side view of the lever connector according to the reference example in a finally fitted state, and FIG. 8B is a side view of the lever connector according to the reference example in a temporarily fitted state.

Figure 8A:
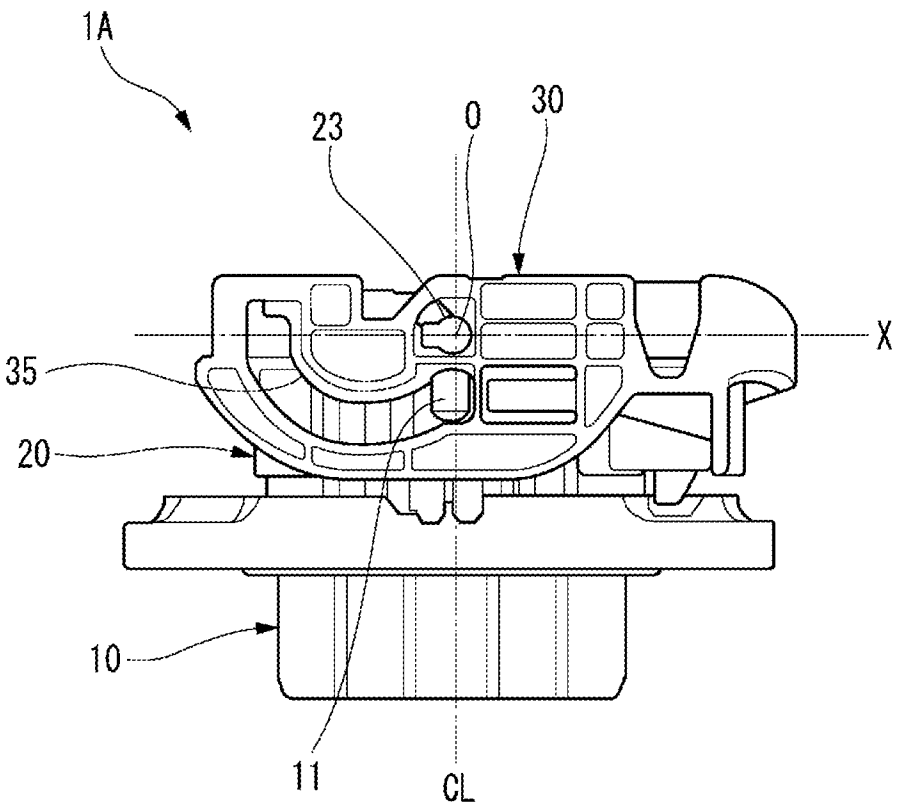

As illustrated in FIG. 8A, in a lever connector 1A according to the reference example, the cam pin 11 of the first connector housing 10 is disposed directly below the rotation center O of the lever 30 in a finally fitted state. That is, the cam pin 11 is disposed below the horizontal line X passing through the rotation center O of the lever 30. In addition, in the finally fitted state, the rotation center O of the lever 30 and the cam pin 11 of the first connector housing 10 are disposed substantially on the center line CL of the main switch units MSw and of the sub-switch units SSw.

As illustrated in FIG. 8B, the cam pin 11 is pushed down along the cam groove 35 when the lever 30 at the second operation position is pulled up to rotate to the first operation position, so that the support shaft 23 is pushed up relative to the cam pin 11. Accordingly, the second connector housing 20 is displaced toward the detachment direction relative to the first connector housing 10.

Next, methods of setting the cam grooves 35 in the lever connector 1 according to the present embodiment and the lever connector 1A according to the reference example will be described.

Figure 9A:
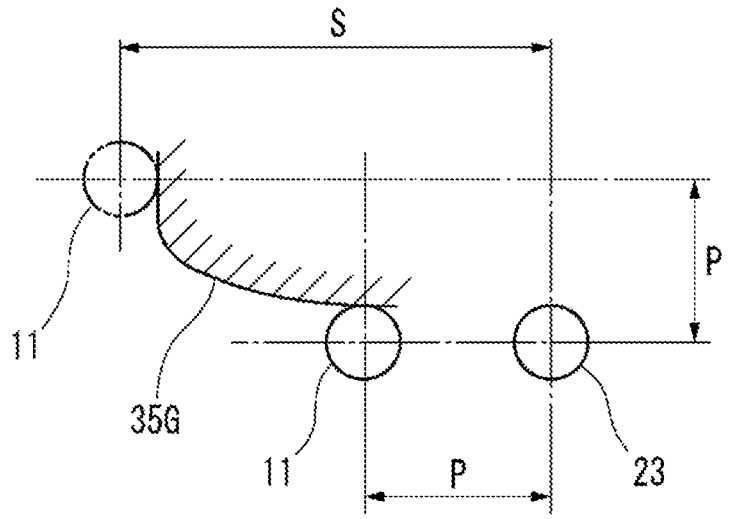
FIGS. 9A and 9B are diagrams illustrating a method of setting a guide shape of a cam groove.
Figure 9B:
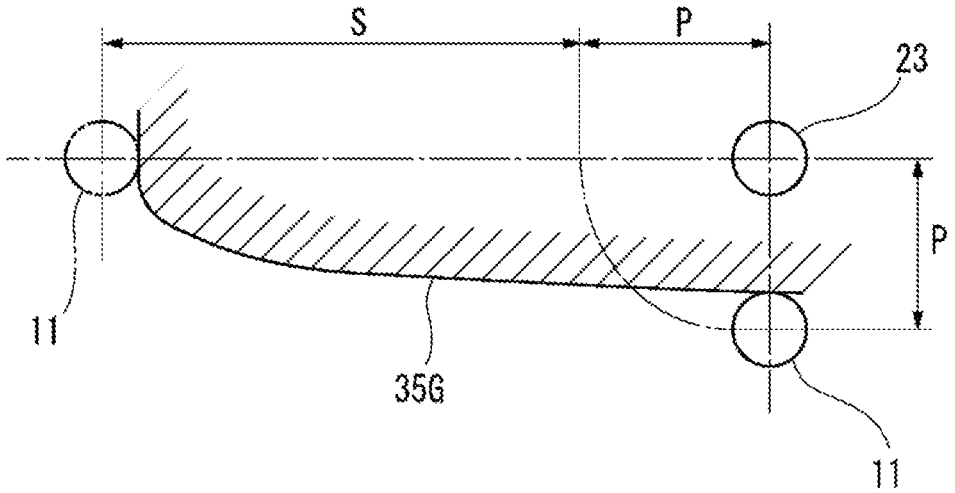

FIG. 9 is a diagram illustrating a method of setting a guide shape of a cam groove, in which FIG. 9A is a schematic diagram illustrating a method of setting a guide shape in the lever connector according to the present embodiment, and FIG. 9B is a schematic diagram illustrating a method of setting a guide shape in the lever connector according to the reference example. An insertion/removal stroke for turning on/off the main switch unit MSw and the sub-switch unit SSw from the finally fitted state is set to S, and an initial interval between the rotation center O of the lever 30 and the cam pin 11 in the finally fitted state is set to P.

Case of Present Embodiment

As illustrated in FIG. 9A, in the case of setting the cam groove 35, first, a position of the cam pin 11 in the finally fitted state where the lever 30 is disposed at the second operation position is determined. Then, a position of the cam pin 11 (position indicated by an imaginary line in FIG. 9A) in the temporarily fitted state where the lever 30 is disposed at the first operation position is determined. Thereafter, a guide shape (curve) of the cam groove 35 is set between the position of the cam pin 11 when the lever 30 is at the second operation position and the position of the cam pin 11 when the lever 30 is at the first operation position. In the lever connector 1 according to the present embodiment, the cam pin 11 is disposed on the horizontal line X passing through the rotation center O of the lever 30 in the finally fitted state. In such an disposition, when a guide shape 35G of the cam groove 35 is set, a horizontal length of the guide shape 35G can be reduced to the same length (S) as the insertion/removal stroke S. Therefore, the length of the cam groove 35 formed in the lever 30 can be reduced, and the lever 30 can be miniaturized.

(Case of Reference Example)

As illustrated in FIG. 9B, in the case of setting the cam groove 35, first, a position of the cam pin 11 in the finally fitted state where the lever 30 is disposed at the second operation position is determined. Then, a position of the cam pin 11 (position indicated by an imaginary line in FIG. 9B) in the temporarily fitted state where the lever 30 is disposed at the first operation position is determined. Thereafter, a guide shape (curve) of the cam groove 35 is set between the position of the cam pin 11 when the lever 30 is at the second operation position and the position of the cam pin 11 when the lever 30 is at the first operation position. In the lever connector 1A according to the reference example, the cam pin 11 is disposed on a center line CL that is a vertical line below the rotation center O of the lever 30 in the finally fitted state. In such an disposition, when the guide shape 35G of the cam groove 35 is set, a horizontal length of the guide shape 35G of the cam groove 35 is a length (S+P) obtained by adding the initial interval P to the insertion/removal stroke S. Therefore, the length of the cam groove 35 formed in the lever 30 is increased, and the lever 30 is increased in size.

Next, a force acting on the cam pin 11 during the rotation of the lever 30 will be described.

Figure 10:
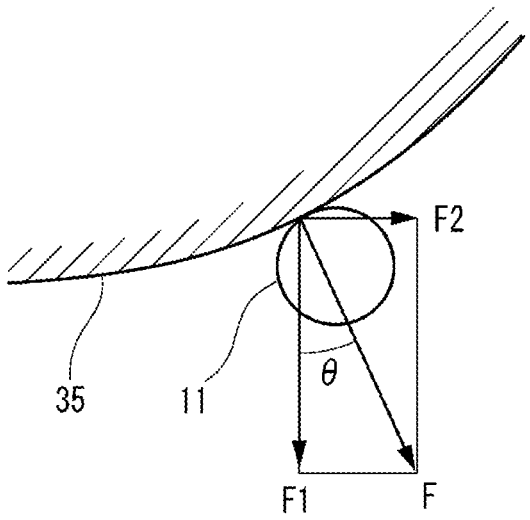
FIG. 10 is a schematic diagram illustrating a force received by the cam pin from the cam groove during rotation of the lever.

FIG. 10 is a schematic diagram illustrating a force received by the cam pin from the cam groove during the rotation of the lever.

As illustrated in FIG. 10, when the lever 30 is rotated to make the cam pin 11 move relative to the cam groove 35, a pressing force F accompanying a rotation force of the lever 30 is applied from a wall surface of the cam groove 35 to the cam pin 11 in an inclination angle θ relative to the vertical direction. Therefore, by rotating the lever 30, a component force F1 of the pressing force F (F1=F cos θ) in the vertical direction is applied as a detachment force (fitting force) between the first connector housing 10 and the second connector housing 20. Further, a component force F2 of the pressing force F (F2=F sin θ) in the horizontal direction is not applied as a detachment force (fitting force) and is wasted. Therefore, by reducing the inclination angle θ of the pressing force F relative to the vertical direction, the pressing force F accompanying the rotation force of the lever 30 is prevented from being wasted and is applied as a detachment force (fitting force).

In the lever connector 1 according to the present embodiment, the guide shape 35G can further approximate to an arc by reducing the length of the cam groove 35 formed in the lever 30. Then, a contact portion between a wall surface of the cam groove 35 and the cam pin 11 approaches the vertical axis, so that the inclination angle θ of the direction of the pressing force F relative to the vertical direction can be reduced. Accordingly, the pressing force F accompanying the rotation force of the lever 30 can be prevented from being wasted and can be used as a detachment force (fitting force).

In contrast, in the lever connector 1A according to the reference example, a length of the cam groove 35 formed in the lever 30 is increased, and thus the guide shape 35G of the cam groove 35 becomes a curved shape with a large curvature. Then, a contact portion between a wall surface of the cam groove 35 and the cam pin 11 is far from the vertical axis, and the inclination angle θ of the direction of the pressing force F relative to the vertical direction is increased. Accordingly, the component force F2 becomes large and is not effectively used as a detachment force (fitting force). The component force F2 is a wasteful force in the pressing force F accompanying the rotation force of the lever 30.

As described above, according to the lever connector 1 of the present embodiment, the cam pin 11 is disposed on a lateral side of the rotation center O of the lever 30 and is disposed on a detachment side of the second connector housing 20 relative to the horizontal line X that passes through the rotation center O and is orthogonal to the insertion/removal direction of the first connector housing 10 and the second connector housing 20, so that the length of the cam groove 35 of the lever 30 can be reduced. Accordingly, both the lever 30 and the entire connector can be miniaturized.

Further, the shape of the cam groove 35 can further approximate to an arc by reducing the length of the cam groove 35 of the lever 30. Accordingly, the pressing force F generated by the rotation of the lever 30 can be further applied along the insertion/removal direction, and the pressing force F can be prevented from being wasted and can be used as the fitting force and the detachment force. Further, the operability can be improved.

In addition, the rotation center O and the cam pin 11 to which the fitting force and the detachment force are applied by rotating the lever 30 are disposed on two sides of the center line CL of the main switch units MSw and of the sub-switch units SSw. Therefore, the fitting force and the detachment force applied by the rotation of the lever 30 are applied in a well-balanced manner, so that the terminals of the main switch unit MSw and the sub switch unit SSw can be smoothly inserted and removed, and the on/off operation of the main switch unit MSw and the sub switch unit SSw can be favorably performed.

Particularly, the rotation center O and the cam pin 11 are disposed at an equal distance from the center line CL of the main switch units MSw and of the sub-switch units SSw. Accordingly, the fitting force and the detachment force applied by the rotation of the lever 30 can be applied in a more balanced manner, and the terminals of the main switch unit MSw and the sub-switch unit SSw can be smoothly inserted and removed.

The lever connector 1 is used as a service plug that disconnects the energization between the power supply unit and the load in the above embodiment. However, the lever connector 1 is not limited to the service plug, and is used as various connectors for conducting/disconnecting the circuit.

Here, the lever connector 1 having the structure of the invention is compared with the lever connector 1A of the reference example in terms of a relationship between the lever angle α at the time of detaching the second connector housing 20 from the first connector housing 10 by rotating the lever 30 by 15° and inclination angle θ of the pressing force F direction relative to the vertical direction that is the insertion/removal direction.

FIG. 11A to 11F are schematic diagrams illustrating an inclination angle of a pressing force acting on the cam pin in the lever connector of the invention, and illustrate a positional relationship between a rotation center of a lever and a cam pin in a cam groove. FIG. 12A to 12F are schematic diagrams illustrating an inclination angle of a pressing force acting on the cam pin in the lever connector of the reference example, and illustrate a positional relationship between a rotation center of a lever and a cam pin in a cam groove.

Figure 11A:
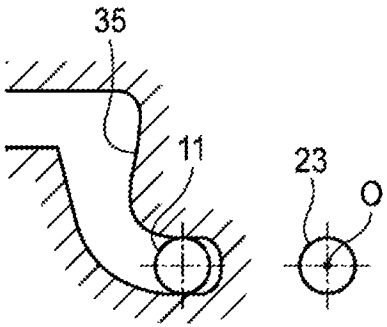
FIG. 11A to 11F are schematic diagrams illustrating an inclination angle of a pressing force acting on the cam pin in the lever connector of the present invention, and illustrate a positional relationship between a rotation center of a lever and a cam pin in a cam groove.
Figure 12A:
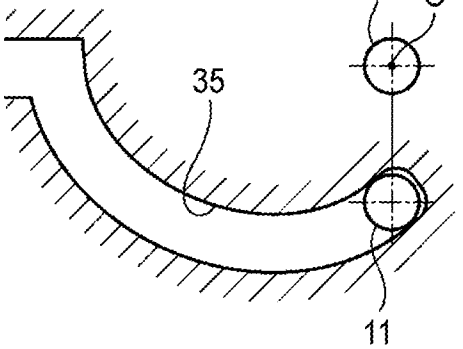
FIG. 12A to 12F are schematic diagrams illustrating an inclination angle of a pressing force acting on the cam pin in the lever connector of the reference example, and illustrates a positional relationship between a rotation center of a lever and a cam pin in a cam groove.

In the finally fitted state, as illustrated in FIG. 11A, the cam pin 11 was disposed on a horizontal line passing through the rotation center O of the lever 30 in the lever connector 1 of the present invention. In the finally fitted state, as illustrated in FIG. 12A, the cam pin 11 was disposed on a vertical line passing through the rotation center O of the lever 30 in the lever connector 1A of the reference example. In addition, a pitch between the rotation center O of the lever 30 and the cam pin 11 in the finally fitted state was set to 14.0 mm, and the stroke amount of the second connector housing 20 relative to the first connector housing 10 was set to 20.5 mm in the lever connector 1 and the lever connector 1A.

(Lever Angle $\alpha$=15°)

Figure 11B:
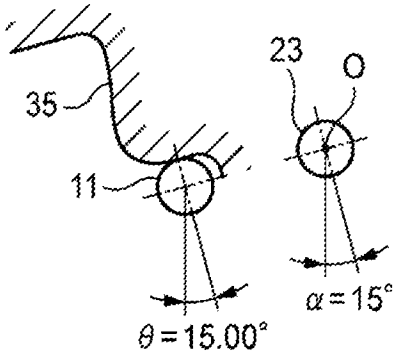
Figure 12B:
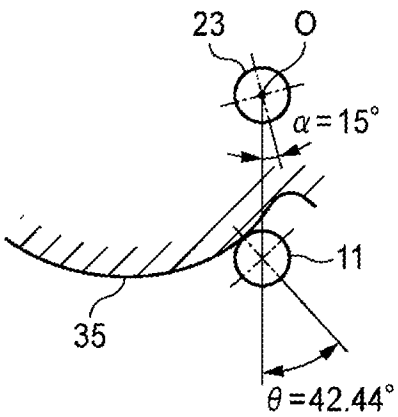

As illustrated in FIG. 11B, the inclination angle $\theta$ of the pressing force F was 15.00° in the lever connector 1 of the invention when the lever angle $\alpha$ was 15°. As illustrated in FIG. 12B, the inclination angle $\theta$ of the pressing force F was 42.44° in the lever connector 1A of the reference example when the lever angle $\alpha$ was 15°.

(Lever Angle $\alpha$=30°)

Figure 11C:
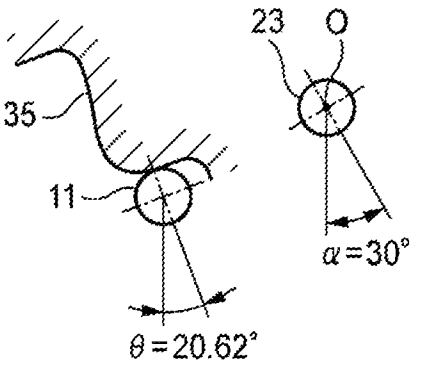
Figure 11D:
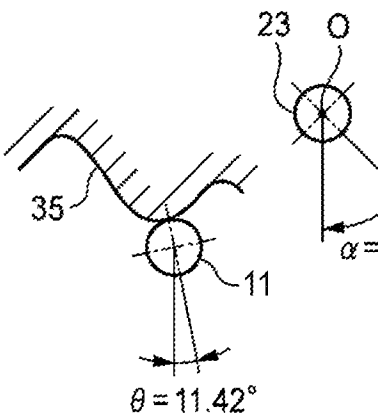
Figure 12C:
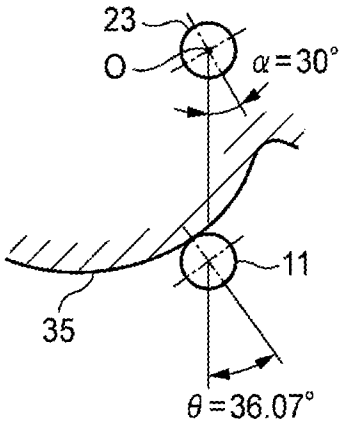

As illustrated in FIG. 11C, the inclination angle $\theta$ of the pressing force F was 20.62° in the lever connector 1 of the invention when the lever angle $\alpha$ was 30°. As illustrated in FIG. 12C, the inclination angle $\theta$ of the pressing force F was 36.07° in the lever connector 1A of the reference example when the lever angle $\alpha$ was 30°.

(Lever Angle $\alpha$=45°)

Figure 12D:
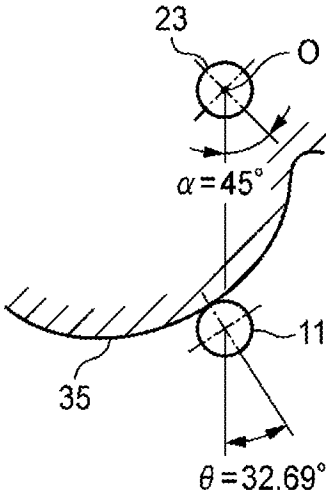

As illustrated in FIG. 1D, the inclination angle $\theta$ of the pressing force F was 11.42° in the lever connector 1 of the invention when the lever angle $\alpha$ was 45°. As illustrated in FIG. 12D, the inclination angle $\theta$ of the pressing force F was 32.69° in the lever connector 1A of the reference example when the lever angle $\alpha$ was 45°.

(Lever Angle $\alpha$=60°)

Figure 11E:
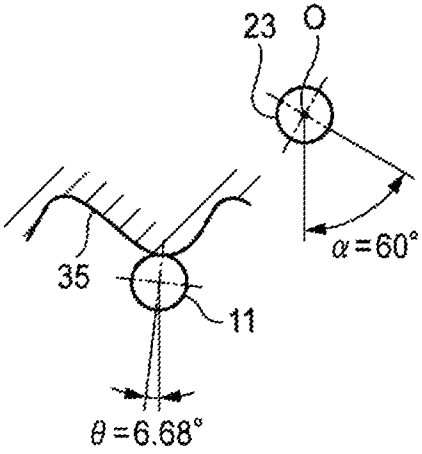
Figure 12E:
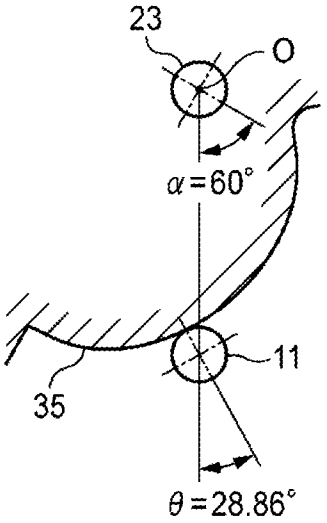

As illustrated in FIG. 11E, the inclination angle $\theta$ of the pressing force F was 6.68° in the lever connector 1 of the invention when the lever angle $\alpha$ was 60°. As illustrated in FIG. 12E, the inclination angle $\theta$ of the pressing force F was 28.86° in the lever connector 1A of the reference example when the lever angle $\alpha$ was 60°.

(Lever Angle $\alpha$=75°)

Figure 11F:
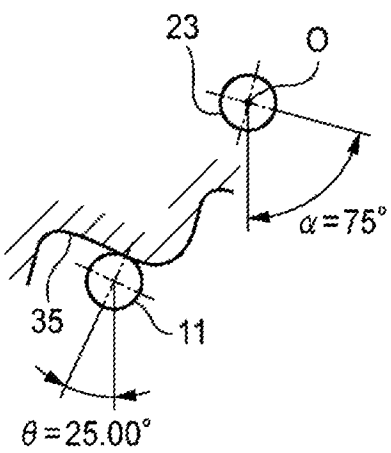
Figure 12F:
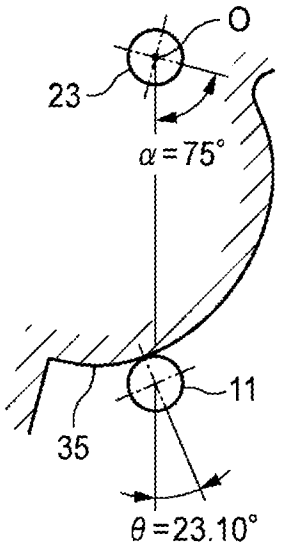

As illustrated in FIG. 11F, the inclination angle $\theta$ of the pressing force F was 25.00° in the lever connector 1 of the invention when the lever angle $\alpha$ was 75°. As illustrated in FIG. 12F, the inclination angle $\theta$ of the pressing force F was 23.10° in the lever connector 1A of the reference example when the lever angle $\alpha$ was 75°.

Figure 13:
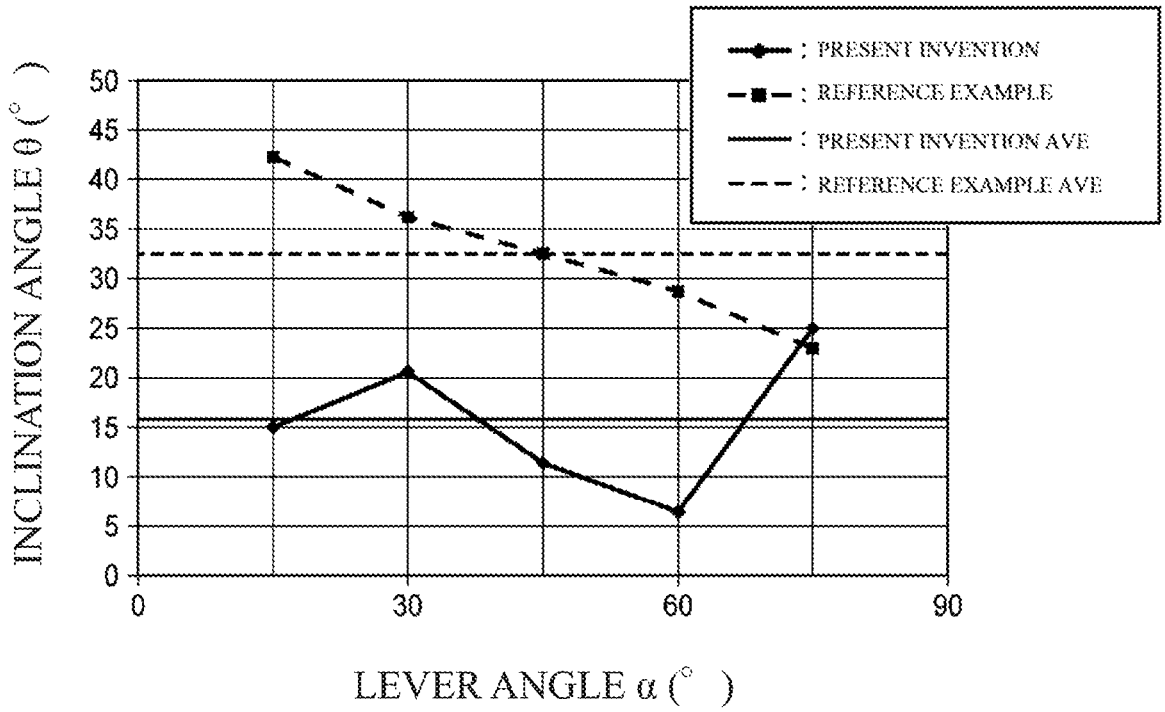
FIG. 13 is a graph illustrating a relationship between an inclination angle of a direction of the pressing force and a lever angle.

FIG. 13 is a graph illustrating a relationship between a lever angle $\alpha$ of the lever 30 and an inclination angle $\theta$ of the direction of the pressing force. In FIG. 13, the inclination angle $\theta$ of the lever connector 1 of the invention is indicated by a solid line, and the inclination angle $\theta$ of the lever connector 1A of the reference example is indicated by a broken line.

As illustrated in FIG. 13, the inclination angle $\theta$ of the lever connector 1 of the invention is slightly larger than that of the lever connector 1A of the reference example when the lever angle $\alpha$ is equal to 75°. However, in the case of the lever angle $\alpha$ other than 75°, the inclination angle $\theta$ of the pressing force F could be made smaller than that of the lever connector 1A of the reference example. Accordingly, the average inclination angle $\theta$ of the pressing force F in the lever connector 1 of the invention could be significantly reduced, compared with the lever connector 1A of the reference example.

That is, according to the lever connector 1 of the invention, the shape of the cam groove 35 can further approximate to an arc by reducing the length of the cam groove 35 of the lever 30, and thus the inclination angle $\theta$ could be reduced by making the pressing force F generated by the rotation of the lever 30 further apply along the insertion/removal direction. Therefore, waste of the pressing force F due to the action of the pressing force F in a direction different from the insertion/removal direction could be prevented, and the pressing force F could be used as the fitting force and the detachment force. Further, the operability could be improved.

The invention is not limited to the above embodiments, and may be appropriately modified, improved, and the like. In addition, materials, shapes, sizes, numerals, disposition locations, and the like of constituent elements in the above embodiments are optional as long as the object of the present invention can be achieved, and the present invention is not limited thereto.

Here, characteristics of the embodiment of the lever connector according to the invention are briefly summarized in the following [1] to [3].

[1] A lever connector includes:

a first connector housing (10);

a second connector housing (20) that can be fitted to/detached from the first connector housing (10);

a lever (30) rotatably supported by the second connector housing (20);

a cam pin (11) formed in the first connector housing (10); and a cam groove (35) that is formed in the lever (30), presses the cam pin (11) by rotation of the lever (30), and applies a fitting force and a detachment force between the first connector housing (10) and the second connector housing (20), the cam pin (11) being slidably disposed in the cam groove (35), wherein in a finally fitted state that the first connector housing (10) is completely fitted to the second connector housing (20), the cam pin (11) is disposed on a lateral side of a rotation center (O) of the lever (30), and is disposed on a detachment side of the second connector housing (20) relative to a line (X) that passes through the rotation center (O) and is orthogonal to an insertion/removal direction of the first connector housing (10) and the second connector housing (20).

[2] The lever connector according to [1], wherein the first connector housing (10) and the second connector housing (20) include switch units (main switch unit MSw, sub-switch unit SSw) including a terminal inserted/removed by fitting/removing the first connector housing (10) and the second connector housing (20), and the rotation center (O) of the lever and the cam pin (11) are disposed on two sides of a center line (CL) of the switch units (main switch unit MSw, sub-switch unit SSw).

[3] The lever connector according to [2], wherein the rotation center (O) of the lever and the cam pin 11 are disposed at an equal distance from the center line (CL) of the switch units (main switch unit MSw, sub-switch unit SSw).

What is claimed is:

1. A lever connector comprising:

a first connector housing; a second connector housing that is fitted to and detached from the first connector housing;

a lever rotatably supported by the second connector housing;

a cam pin formed in the first connector housing; and a cam groove that is formed in the lever, presses the cam pin by rotation of the lever, and applies a fitting force and a detachment force between the first connector housing and the second connector housing, the cam pin being slidably disposed in the cam groove, wherein in a finally fitted state that the first connector housing is completely fitted to the second connector housing, the cam pin is disposed on a lateral side of a rotation center of the lever, and is disposed on a detachment side of the second connector housing relative to a line that passes through the rotation center and is orthogonal to an insertion/removal direction of the first connector housing and the second connector housing; and wherein the cam pin is disposed on a line that is a center line of a longitudinal side of the first connector housing in the finally fitted state.

2. The lever connector according to claim 1, wherein the first connector housing and the second connector housing include switch units having a terminal which is inserted/removed by fitting/removing, the first connector housing and the second connector housing, and the rotation center of the lever and the cam pin are disposed on two sides relative to a center line of the switch units.

3. The lever connector according to claim 2, wherein the rotation center of the lever and the cam pin are disposed at an equal distance from the center line of the switch units.

* * * * *